US011318760B2

(12) United States Patent
Hoover et al.

(10) Patent No.: US 11,318,760 B2
(45) Date of Patent: May 3, 2022

(54) MEDIA TRANSPORT BELT THAT ATTENUATES THERMAL ARTIFACTS IN IMAGES ON SUBSTRATES PRINTED BY AQUEOUS INK PRINTERS

(71) Applicant: Xerox Corporation, Norwalk, CT (US)

(72) Inventors: Linn C. Hoover, Webster, NY (US); Douglas K Herrmann, Webster, NY (US); Paul J. McConville, Webster, NY (US); Jason M. LeFevre, Penfield, NY (US); Seemit Praharaj, Webster, NY (US); David A. VanKouwenberg, Avon, NY (US); Michael J. Levy, Webster, NY (US); Chu-heng Liu, Penfield, NY (US); Santokh S. Badesha, Pittsford, NY (US); Christopher Mieney, Rochester, NY (US); David S. Derleth, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 345 days.

(21) Appl. No.: 16/724,437

(22) Filed: Dec. 23, 2019

(65) Prior Publication Data

US 2021/0187968 A1 Jun. 24, 2021

(51) Int. Cl.
*B41J 11/00* (2006.01)

(52) U.S. Cl.
CPC ..... *B41J 11/002* (2013.01); *B41J 11/0085* (2013.01)

(58) Field of Classification Search
CPC ..... B41J 11/002; B41J 11/0085
See application file for complete search history.

(56) References Cited

U.S. PATENT DOCUMENTS 5,717,446 A 2/1998 Teumer et al.
2002/0067403 A1 6/2002 Smith
(Continued)

FOREIGN PATENT DOCUMENTS

EP 3 017 957 A1 5/2016
EP 3 375 619 A1 9/2018
(Continued)

OTHER PUBLICATIONS

European search report corresponding to European patent application No. 20 21 2017 (10 pages).

*Primary Examiner* — Justin Seo
(74) *Attorney, Agent, or Firm* — Maginot Moore Beck LLP

(57) ABSTRACT

An inkjet printer includes a dryer configured to attenuate the effects of temperature differentials arising in substrates that are caused by holes in a media transport belt and a platen covering a vacuum plenum. The dryer includes a heater, a media transport belt cooler, and a media transport belt. The media transport belt is configured to move substrates past the heater after ink images have been formed on the substrates and the media transport belt cooler is positioned to remove heat energy from the media transport belt after the media transport belt has passed the heater and the substrates have separated from the media transport belt. The substrate cooler is configured to reduce a temperature of the media transport belt to a temperature that attenuates image defects arising from temperature differentials in the media transport belt when the media transport belt is opposite the heater.

18 Claims, 6 Drawing Sheets

(56) References Cited

U.S. PATENT DOCUMENTS

| | | | | |
|---|---|---|---|---|
| 2002/0071017 | A1 | 6/2002 | Pitpit et al. | |
| 2007/0247505 | A1 | 10/2007 | Isowa et al. | |
| 2008/0151029 | A1* | 6/2008 | Yokoyama | B41J 11/00218 347/102 |
| 2010/0073410 | A1 | 3/2010 | Yui et al. | |
| 2010/0320677 | A1* | 12/2010 | Bober | B65H 29/16 271/264 |
| 2012/0212537 | A1 | 8/2012 | Takahata | |
| 2012/0319347 | A1* | 12/2012 | Moore | B41J 11/0025 271/12 |
| 2014/0071197 | A1 | 3/2014 | Chiwata et al. | |
| 2015/0029281 | A1 | 1/2015 | Cressman et al. | |
| 2015/0091996 | A1 | 4/2015 | Piatt et al. | |
| 2015/0165790 | A1 | 6/2015 | Rosati et al. | |
| 2015/0375533 | A1 | 12/2015 | Hobo et al. | |
| 2016/0060052 | A1 | 3/2016 | Tojima et al. | |
| 2016/0067985 | A1 | 3/2016 | Akahiri et al. | |
| 2016/0159122 | A1 | 6/2016 | Nishio et al. | |
| 2018/0264852 | A1* | 9/2018 | Ohtake | B65H 37/00 |
| 2018/0339529 | A1 | 11/2018 | Zirilli | |
| 2019/0126638 | A1 | 5/2019 | Muramatsu et al. | |
| 2021/0086532 | A1* | 3/2021 | Horie | B41J 15/048 |

FOREIGN PATENT DOCUMENTS

| | | | | |
|---|---|---|---|---|
| WO | WO-2018207534 | A1 * | 11/2018 | F26B 15/18 |
| WO | 2019/069341 | A1 | 4/2019 | |

* cited by examiner

MEDIA TRANSPORT BELT THAT ATTENUATES THERMAL ARTIFACTS IN IMAGES ON SUBSTRATES PRINTED BY AQUEOUS INK PRINTERS

TECHNICAL FIELD

This disclosure relates generally to aqueous ink printing systems, and more particularly, to media transport belts that carry media through dryers in such printers.

BACKGROUND

Known aqueous ink printing systems print images on uncoated and coated substrates. Whether an image is printed directly onto a substrate or transferred from a blanket configured about an intermediate transfer member, once the image is on the substrate, the water and other solvents in the ink must be substantially removed to fix the image to the substrate. A dryer is typically positioned after the transfer of the image from the blanket or after the image has been printed on the substrate for removal of the water and solvents. To enable relatively high speed operation of the printer, the dryer heats the substrates and ink to temperatures that typically reach about 100° C. for effective removal of the liquids from the surfaces of the substrates.

Coated substrates exacerbate the challenges involved with removing water from the ink images as low porosity clay coatings can prevent ink from wicking into the media substrates. Additionally, temperature gradients can form in the substrates as they pass through the dryer or dryers. Temperature gradients greater than 15-20 degrees C. can cause the water and solvents in the ink to evaporate at different rates. The non-uniformity of the evaporation rate can cause ink to flow on the substrate surface, which concentrates pigments in the ink along the temperature gradient and produces ghost images in solid density coverage areas.

Current media transport belts that carry substrates through the dryer or dryers in a printer pass over a perforated platen covering a vacuum platen. The platen helps support the belt and the substrates on the belt. Some known belts have holes so as the belt passes over the perforated platen covering the vacuum plenum, a vacuum can exert a pull on the media substrates through the perforated platen and the holes in the belt to hold the substrates in position for printing and drying. The substrate areas that are adjacent the holes in the belt are cooler than the substrate areas adjacent the belt material because the void in the belt does not transfer heat energy to the back side of the substrate as the belt material. Instead, the vacuum pulls an air flow through the voids, which cools the portions of the substrates opposite the voids. The resulting temperature differential between these two types of areas in the substrates produces the image defects shown in FIG. 6. As shown in the figure, the darker circles to which the arrows point are the areas that were adjacent the holes of the media transport belt. Vacuum forces inside the holes pull the media against the vacuum hole edges which increases the thermal conduction between the belt and media back side. This increased thermal conduction produces a temperature differential on the media surface. The water and solvents evaporate more quickly in these areas resulting in a higher concentration of ink pigments and dyes there. The ink pigments and dyes are drawn from surrounding areas in the image and lighter density boundaries arise. As shown in the figure, the lighter circles within the darker circles are the areas that were adjacent the holes in the media transport belt.

Some media transport belts are an arrangement of a plurality of belts that pass over the perforated platen covering the vacuum plenum. Because a plurality of belts is provided, each belt is narrower than a width of the media carried by the belt arrangement in the cross-process direction. The temperature of the areas of the substrates that extend beyond the edges of the belts in the belt arrangement is less than the temperature of the substrate areas covering the belts so image defects can arise from this temperature differential. These areas are the straight lines to which the arrows point in FIG. 6. Likewise, the inter-document gaps on the belt or belts between successive media substrates in the process direction are not covered by the substrates so these inter-document gap belt areas are heated to a different temperature than the covered areas of the belt. Since the substrates are not synchronized with the rotation of the media transport belt, an inter-document gap area of the belt during one revolution of the belt is covered by a substrate during a subsequent revolution of the belt. This phenomenon produces thermal bands of different temperatures that extend in the cross-process direction and follow one another in the process direction. These thermal bands result in different ink evaporation rates and possible image defects.

Media transport belts made of porous fabric have been developed to eliminate the vacuum holes and address the image defects arising from temperature differentials in the substrates and media belts. Unfortunately, the needling pattern, stitched seams, or ripples that occur in the fabric of these belts provide non-uniform contact points between the belt and the substrate. The non-uniform contact results in non-uniform thermal conduction between the belt and media which produces temperature differentials with the attendant image defects, particularly in solid ink coverage areas in the ink image. A media transport belt that works with a vacuum system to hold media substrates in place without producing image defects arising from temperature differentials in the substrates and the belt or belts carrying the substrates would be beneficial.

SUMMARY

A new printer includes a dryer that works with a vacuum system to hold media substrates against the belt without producing image defects arising from temperature differentials in the substrates. The printer includes at least one printhead configured to eject drops of an ink onto substrates moving past the at least one printhead to form ink images on the substrates, and a dryer having a heater, a media transport belt cooler, and a media transport belt. The media transport belt is configured to move the substrates past the heater after the ink images have been formed on the substrates and the media transport belt cooler being positioned to remove heat energy from the media transport belt after the media transport belt has passed the heater and the substrates have separated from the media transport belt.

A new dryer for an aqueous ink printing system works with a vacuum system to hold media substrates against the belt without producing image defects arising from temperature differentials in the substrates. The dryer includes a heater, a media transport belt cooler, and a media transport belt. The media transport belt is configured to move substrates past the heater after ink images have been formed on the substrates and the media transport belt cooler being positioned to remove heat energy from the media transport belt after the media transport belt has passed the heater and the substrates have separated from the media transport belt.

BRIEF DESCRIPTION OF THE DRAWINGS

The foregoing aspects and other features of a media transport belt that works with a vacuum system to hold media substrates against the belt without producing image defects arising from temperature differentials in the substrates are explained in the following description, taken in connection with the accompanying drawings.

DETAILED DESCRIPTION

Figure 1:
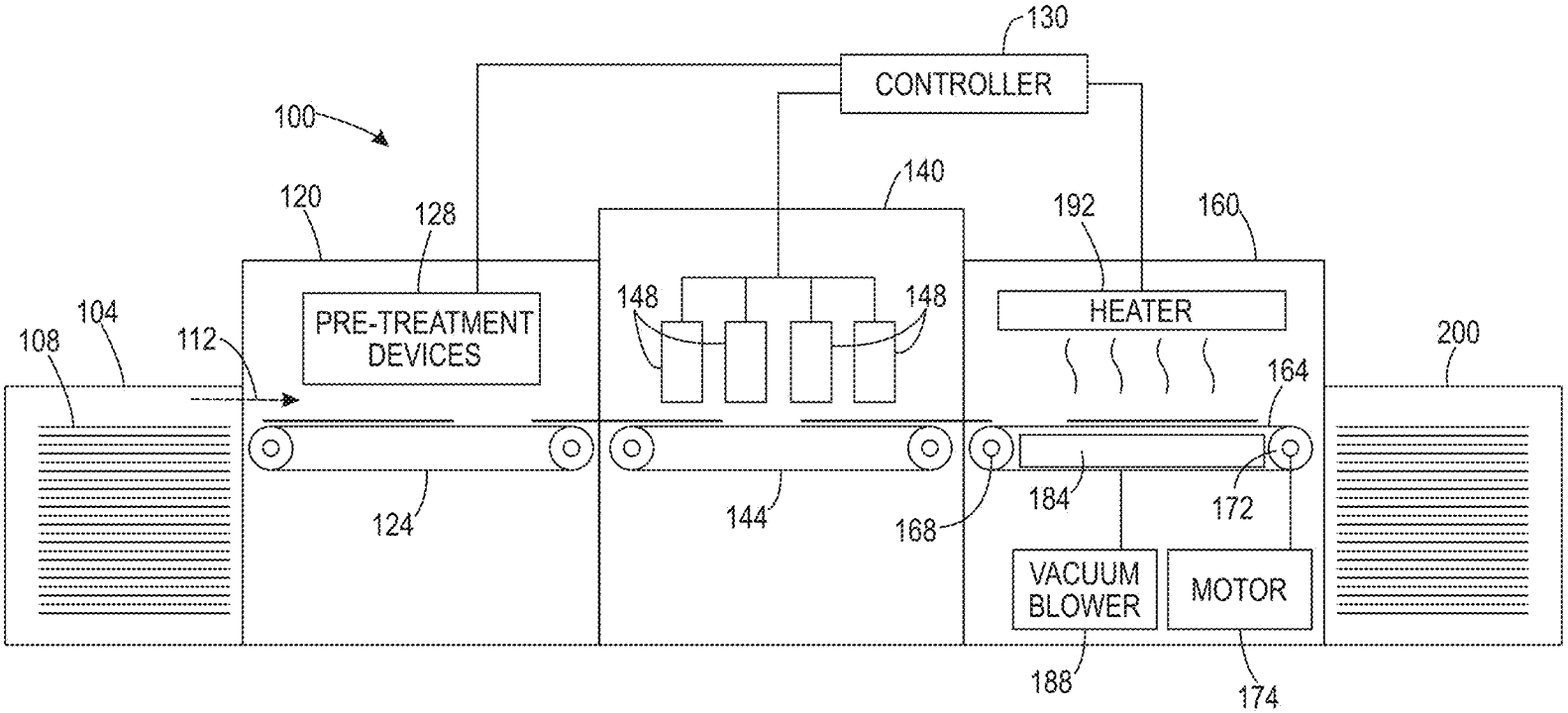
FIG. 1 is a schematic diagram of an aqueous ink printing system having a media transport belt that works with a vacuum system to hold media substrates against the belt without producing image defects arising from temperature differentials in the substrates.

For a general understanding of the present embodiments, reference is made to the drawings. In the drawings, like reference numerals have been used throughout to designate like elements.

FIG. 1 depicts a block diagram of an aqueous printer 100 that is configured to print images on substrates carried by a new media transport belt configured to work with a vacuum system to hold media substrates against the belt without producing image defects arising from temperature differentials in the substrates. The printer 100 includes a media supply 104, a pretreating unit 120, a marking unit 140, a drying unit 160, and a media receptacle 200. The media supply 104 stores a plurality of media sheets 108 for printing by the printer 100. The media sheets 108 may, in some embodiments, be clay-coated or other types of treated paper.

The pretreating unit 120 includes at least one transport belt 124, which receives the media sheets 108 from the media supply 104 and transports the media sheets 108 in a process direction 112 through the pretreating unit 120. The pretreating unit 120 includes one or more pretreating devices 128 that condition the media sheets 108 and prepare the media sheets 108 for printing in the marking unit 140. The pretreating unit 120 may include, for example, one or more of coating devices that apply a coating to the media sheets 108, a drying device that dries the media sheets 108, and a heating device that heats the media sheets 108 to a predetermined temperature. In some embodiments, the printer 100 does not include a pretreating unit 120 and media sheets 108 are fed directly from the media supply 104 to the marking unit 140. In other embodiments, the printer 100 may include more than one pretreating unit.

The marking unit 140 includes at least one marking unit transport belt 144 that receives the media sheets 108 from the pretreating unit 120 or the media supply 104 and transports the media sheets 108 through the marking unit 140. The marking unit 140 further includes at least one printhead 148 that ejects aqueous ink onto the media sheets 108 as the media sheets 108 are transported through the marking unit 140. In the illustrated embodiment, the marking unit 140 includes four printheads 140, each of which ejects one of cyan, magenta, yellow, and black ink onto the media sheets 108. The reader should appreciate, however, that other embodiments include other printhead arrangements, which may include more or fewer printheads, arrays of printheads, and the like.

With continued reference to FIG. 1, dryer 160 includes a media transport belt 164 that receives the media sheets 108 from the marking unit 140. The drying belt 164 is tensioned between an idler roller 168 and a driven roller 172, which is driven by an electric motor 174. The dryer 108 is configured to expose the printed substrates to heat having an adequate temperature to remove the water and solvents in the aqueous ink on the substrates without producing image defects arising from temperature differentials. To accomplish this goal, the media transport belt 164 in dryer 160 is configured with the structure described in more detail below. The heater 192 is positioned within the dryer 160 to direct heat toward the substrates passing through the dryer 108. The heater 192 can be one or more arrays of various types of radiators of electromagnetic radiation, such as infrared (IR) radiators, microwave radiators, or more conventional heaters such as convection heaters. After passing through the dryer 160, the substrates are carried by the belt 164 to the output tray 200. The pre-treating unit 120, the marking unit 140, and the dryer 160 are operated by a controller 130. The controller is configured with programmed instructions stored in a memory operatively connected to the controller so the controller performs functions in the printer by operating various printer components when the controller executes the stored programmed instructions. Although only one controller is shown in FIG. 1 for simplicity, multiple controllers can be used for the various functions and these controllers can communicate with one another to synchronize the functions that they perform.

Figure 2:
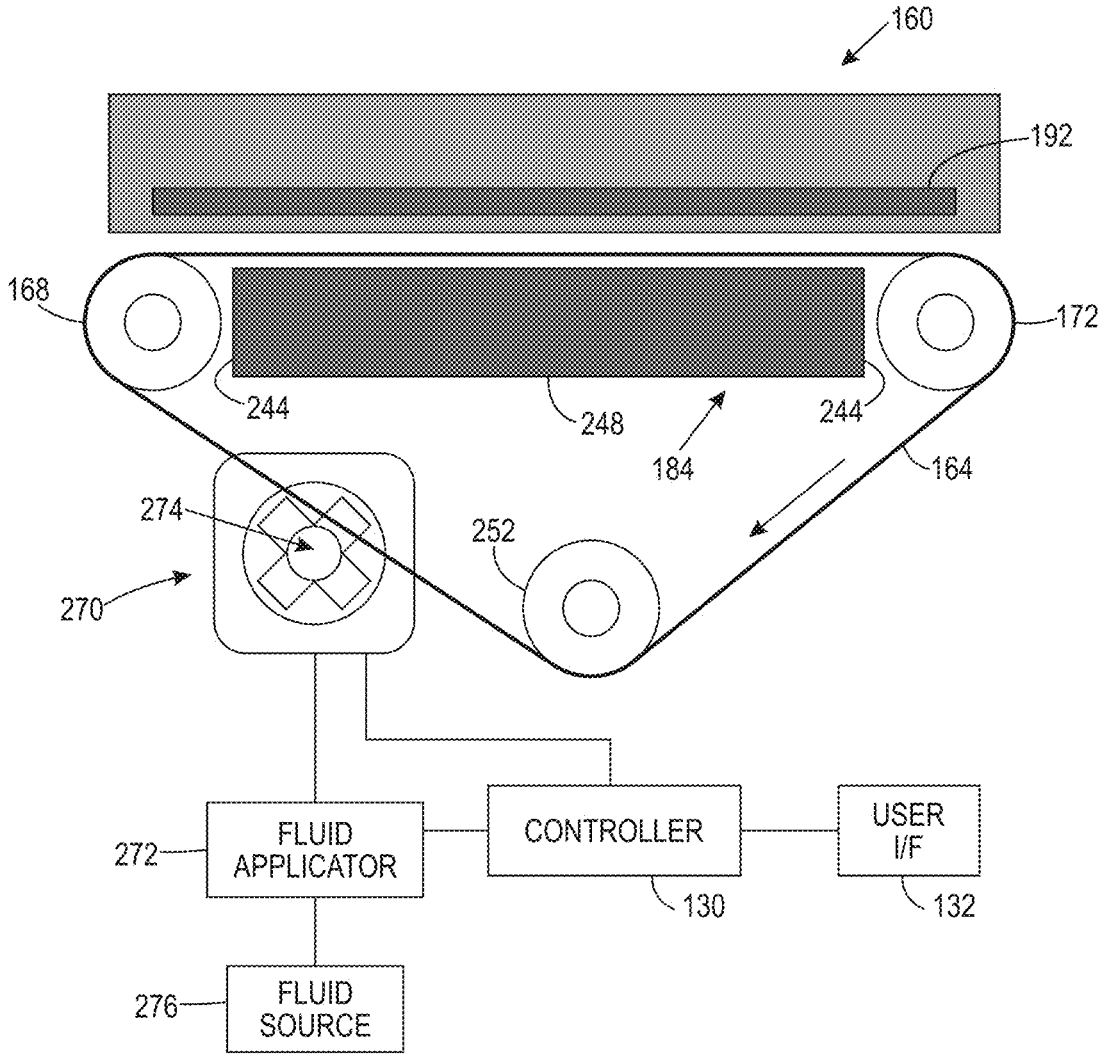
FIG. 2 is a side view of the dryer of FIG. 1.
Figure 3:
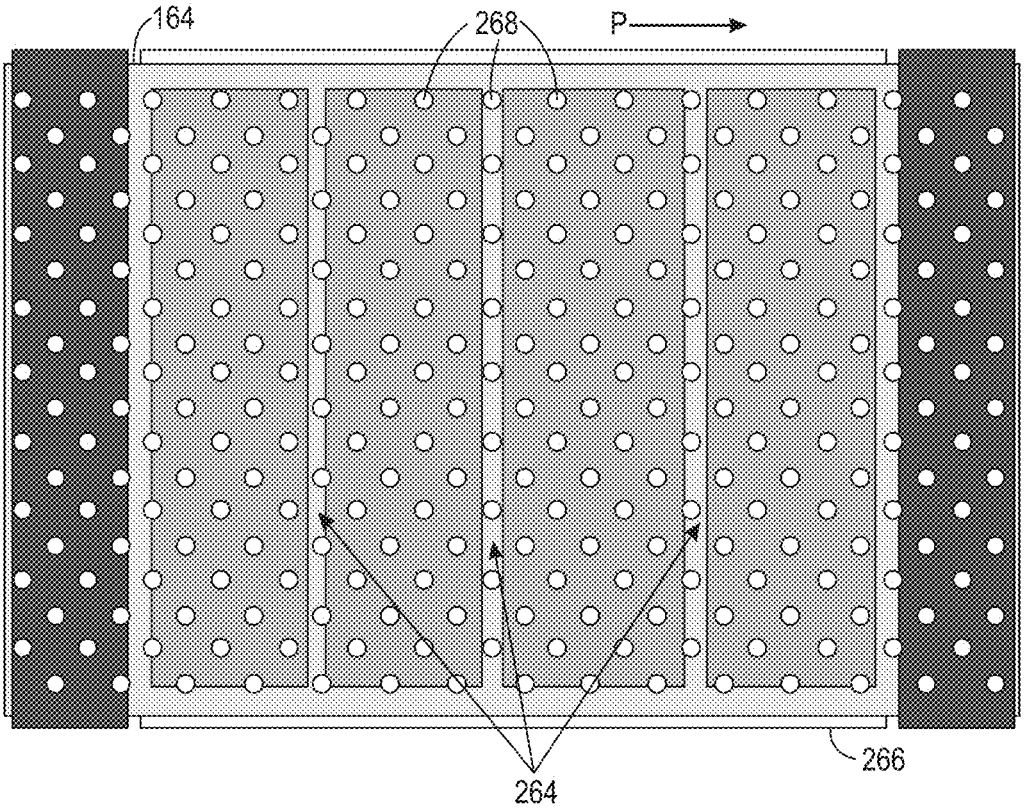
FIG. 3 is a top view of the dryer transport of FIG. 1.

FIG. 2 is a side view of the dryer 160 that is configured with a new media transport belt 164 and vacuum plenum 184 that is not covered with a vacuum platen. Instead, the vacuum plenum 184 is a five-sided box with side plates 244 and a bottom plate 248 but no top platen having holes or slots in a plate placed over the box and over which the media transport belt typically slides. The plenum has flanges 266 around the top surface as shown in FIG. 3. The flanges support the media transport belt 164 and provide a surface for the media transport belt 164 to seal the top of the vacuum plenum so vacuum air flow is directed through the belt holes and not lost around the plenum edges. This configuration removes the metal vacuum plenum plate having vacuum holes that were a source of temperature differentials as noted previously. In some embodiments, the length of the vacuum platen in the process direction is sufficiently short that no media belt support is required across the vacuum platen in the cross-process direction. That is, the tension roller 252 can keep the media transport belt 164 sufficiently taut in the process direction between the idler roller 168 and the driver roller 172 that no other support is required in the vacuum plenum to keep the belt relatively flat. As used in this document, the term "process direction" means the direction of media transport belt movement in the printer and the term "cross-process direction" means the axis that is perpendicular to the process direction in the plane of the media transport belt. The plenum 184 and media transport belt 164 are wider in the cross-process direction than the width of the widest media that can be printed by the printer 100. This configuration ensures that the media substrates cannot extend over the flanges 266, which can be a source of temperature differentials in the substrates as noted previously.

In some embodiments, the length of the vacuum plenum 184 in the process direction requires one or more belt supports 264 that extend between the flanges 266 as shown in FIG. 3. FIG. 3 is a top view of the dryer transport from the perspective of the heater 192 looking down toward the media transport belt 164 as the belt moves over the open plenum 184. The process direction is shown in the figure by the letter P and the arrow. To prevent temperature differentials, the belt supports 264 have a continuous surface, which means that no holes or other voids are in the surface of the supports that contact the belt 164. Thus, another source of temperature differential in the process direction is removed. The supports can be stationary structures or they can be idler rollers that rotate as the belt contacts and moves over the supports. The supports can be perpendicular or angled relative to the belt travel. The belt supports 264 also extend across the entire width of the vacuum plenum 184 to maintain continuous contact and provide a uniform thermal heat sink with the media transport belt 164 in the cross-process direction within the plenum.

The media transport belt 164 is configured to be thin and comprised of a material that is transparent to or reflective of the heat energy produced by the heaters 192. As used in this document, the term "thin" means a belt thickness substantially less than the thickness of belts used in previously known dryers so the thermal mass of the belt is reduced from one having the same length and width. In one embodiment, the belt thickness is in the range of about 50 μm to about 200 μm. By keeping the belt relatively thin, its thermal mass is minimized. The importance of a minimal thermal mass is discussed below. In one embodiment in which the heaters are IR heaters, the belt 164 is made from polyimide rather than silicone, which is used in previously known belts. Polyimide, polyethylene, and polypropylene are relatively transparent to IR but some sources of these materials include a number of additives in the materials that may absorb IR. These additives may require additional dryer configuration adjustments as described below. The media transport belt 164 also includes vacuum holes 268 (FIG. 3) that have a small diameter. In one embodiment, the holes are 100-150 μm in diameter and are at least less than 300 μm in diameter. Holes in this range are adequate to apply a vacuum force to capture and hold media substrates transported by the belt without generating temperature differentials at the surface of the media substrate.

In a known printer having a dryer that uses one or more silicone belts with openings greater than 300 μm, the IR radiators are activated at 75% of their power level twenty-three seconds prior to the arrival of the substrates at the dryer. The silicone belt absorbs this heat energy as its temperature peaks at 105 degrees C. One hundred blank substrates are fed through the dryer to stabilize the belt temperature since the substrates absorb the IR energy. Thus, this known belt has a temperature that stabilizes in a range of about 75 degrees C. to about 80 degrees C. At these temperatures, temperature differentials arise in the belt around the vacuum holes and the belt edges and produce artifacts in some colors of the ink image.

To reduce these differentials and attenuate their effects on the ink images, a media transport belt cooler 270 has been developed. In one embodiment of the media transport belt cooler, a fluid applicator 272, which is operatively connected to a fluid source 276, applies a fluid, such as water, to the belt at a position below the vacuum plenum 184 (FIG. 2). The fluid applicator 272 can be a roller that applies the fluid by contact with the belt, a spray head that directs a mist toward the belt, and the like. The applied fluid evaporates before the belt reaches the idler roller 168 and contacts the substrates. To aid in the evaporation process, the cooler 270 includes a fan 274 or other source of air flow, such as a chiller, that directs ambient or chilled air toward the belt to aid in evaporation of the fluid from the belt and the cooling of the belt. This combination lowers the temperature of the previously known silicone belt to a range of about 50 degrees C. to about 55 degrees C. and keeping the belt in this temperature range removes most of the effects of the temperature differentials in the ink images. The controller 130 operates the fan 274 and the fluid applicator 272 to adjust the speed of the fan and the amount of fluid applied to the belt. These operations are performed using data supplied to the controller 130 through the user interface 132. For example, the type of paper, which identifies the thermal mass of the paper, the presence or absence of coatings, and the like, can be used by the controller to operate the fan at one of a number of predetermined speeds and adjust the amount of fluid applied to the belt. Thus, the addition of a belt cooler along a portion of the belt free from the substrates and not exposed to the heater 192 can be effective in attenuating artifacts in ink images dried by a known dryer in previously known printers. The smaller thermal mass of the media transport belt 164 described above further enhances the effect of the belt cooler 270 since that IR reflective or transparent belt absorbs less heat energy to be dissipated by the belt cooler. Specifically, the IR transparent polyimide belt temperature peaks at about 90 degrees C. rather than 105 degrees C. for the thicker silicone belt. The applied fluid coupled with the air flow from the fan 274 cools the belt surface temperature to about 40 degrees C., which is more effective for preventing image artifacts than the 50 degree C. temperature achieved with the silicone belt.

Figure 4:
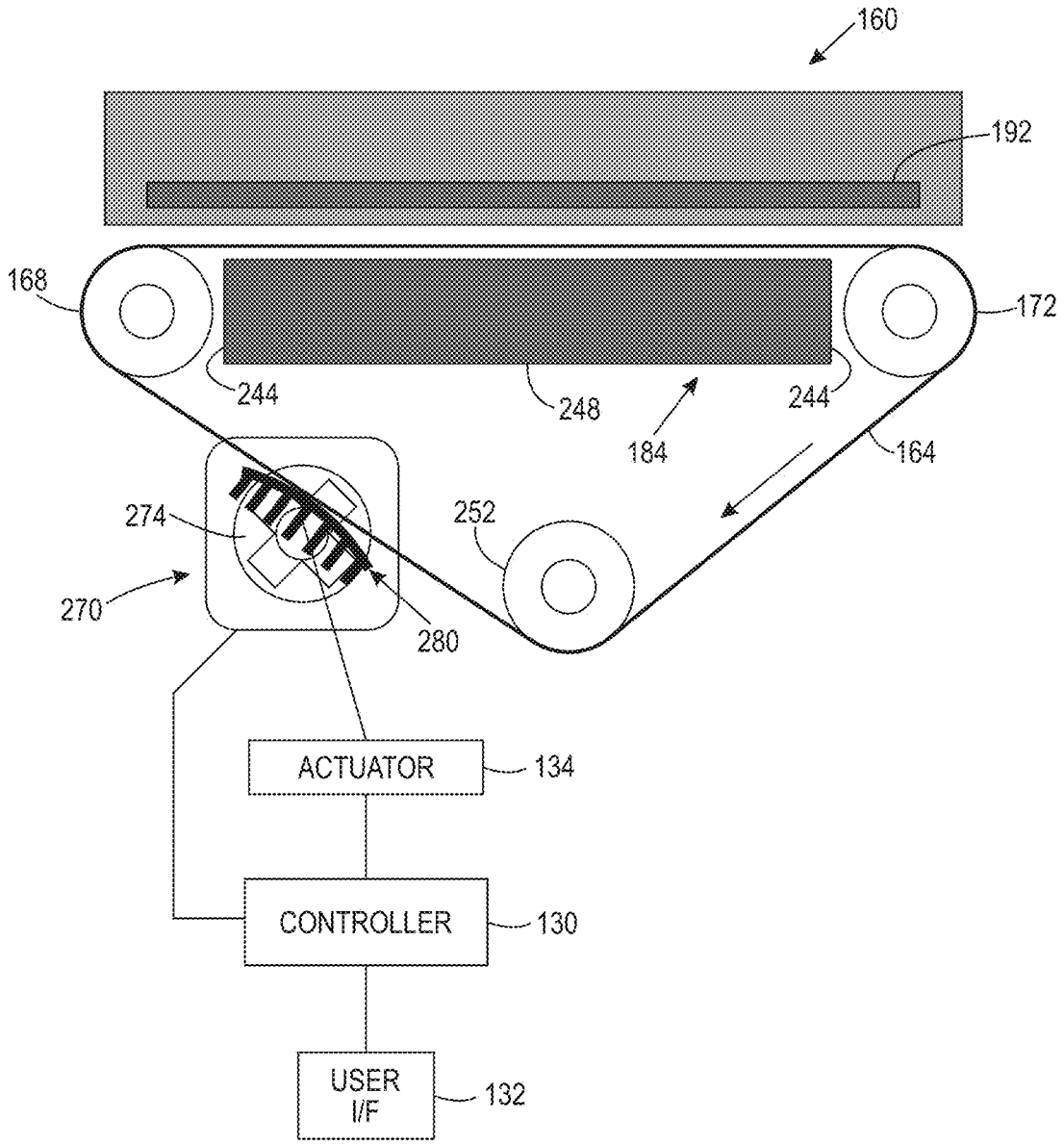
FIG. 4 is a side view of an alternative embodiment of the dryer shown in FIG. 2.

Another embodiment of the dryer is shown in FIG. 4. In this embodiment, the media transport belt cooler 270 has a fan 274 and the fluid applicator has been replaced with a metal heat sink 280, which is relatively thin and is made from a metal that makes the heat sink flexible, such as aluminum. The heat sink 280 is operatively connected to an actuator 134. The controller 130 operates the fan 274 and the actuator 134 to adjust the speed of the fan and the amount of belt area contacting the heat sink. These operations are performed using data supplied to the controller 130 through the user interface 132. For example, the type of paper, which identifies the thermal mass of the paper, the presence or absence of coatings, and the like, can be used by the controller to operate the fan at one of a number of predetermined speeds and adjust the position of the heat sink with respect to the belt to increase or decreases the amount of belt area contacting the heat sink. Thus, the addition of a belt cooler along a portion of the belt free from the substrates and not exposed to the heater 192 can be effective in attenuating artifacts in the ink images dried by the dryer 160. As the heat sink absorbs heat energy from the media transport belt, the temperature of the belt drops before the belt reaches the idler roller 168 and contacts the substrates. The heat sink configuration of FIG. 4 also lowers the temperature of the previously known silicone belt to a range of about 50 degrees C. to about 55 degrees C. and keeping the belt in this temperature range removes most of the effects of the temperature differentials in the ink images. Thus, the addition of a media transport belt cooler positioned to cool the belt after the belt has passed the heater 192 and after the substrates have been separated from the media transport belt can be effective in attenuating artifacts in ink images dried by the known dryers in previously known printers. The smaller thermal mass of the media transport belt 164 in dryer 160 described above further enhances the effect of the belt cooler 270 shown in FIG. 4 since that IR reflective or transparent belt absorbs less heat energy to be dissipated by the belt cooler. Specifically, the IR transparent polyimide belt temperature peaks at about 90 degrees C. rather than 105 degrees C. for the thicker silicone belt. The heat sink 280 and fan 274 of the cooler 270 cools the belt surface temperature to about 40 degrees C., which is more effective for preventing image artifacts than the 50 degree C. temperature achieved with the silicone belt alone.

Figure 5:
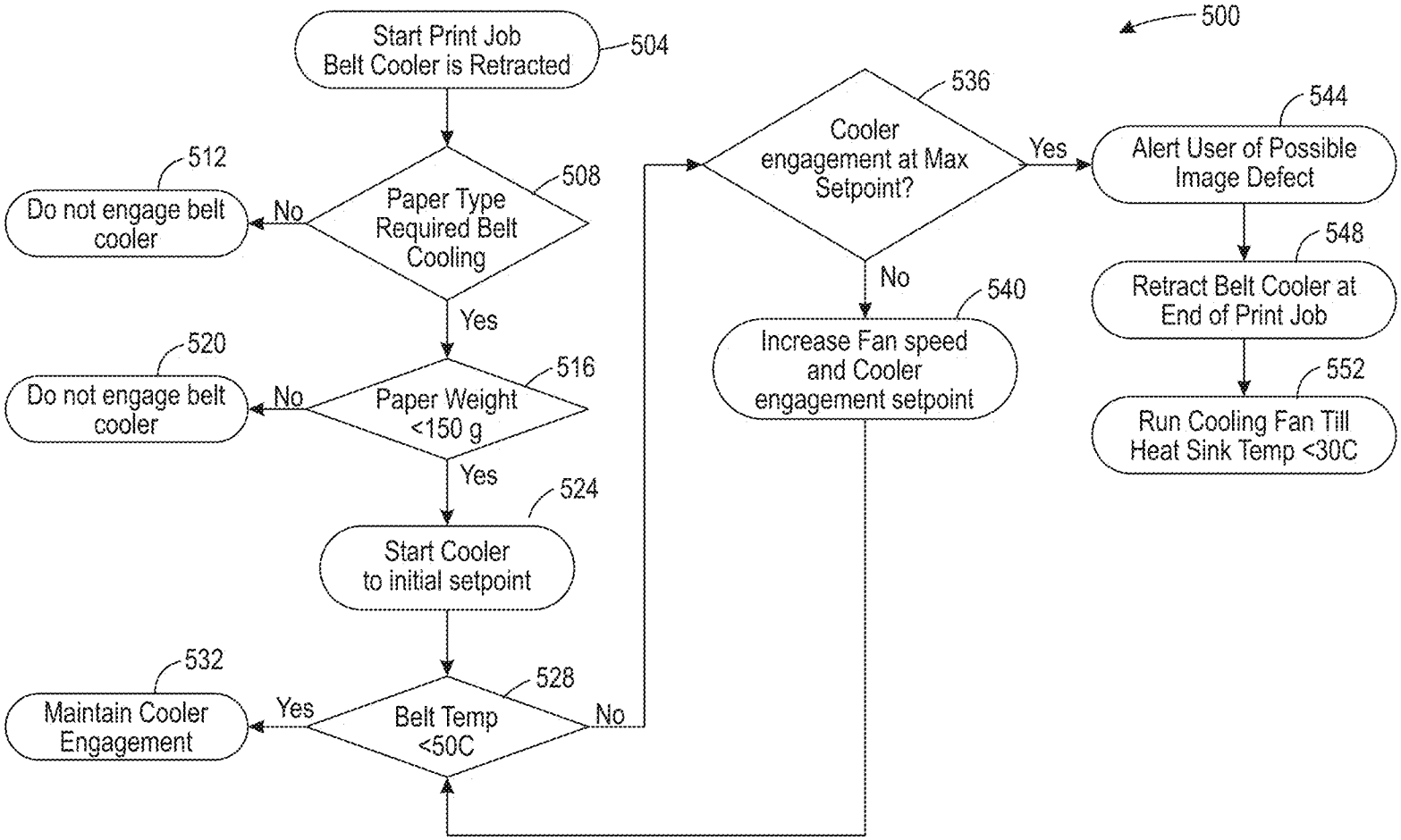
FIG. 5 is a flow diagram of a process for operating the dryer of FIG. 4.
Figure 6:
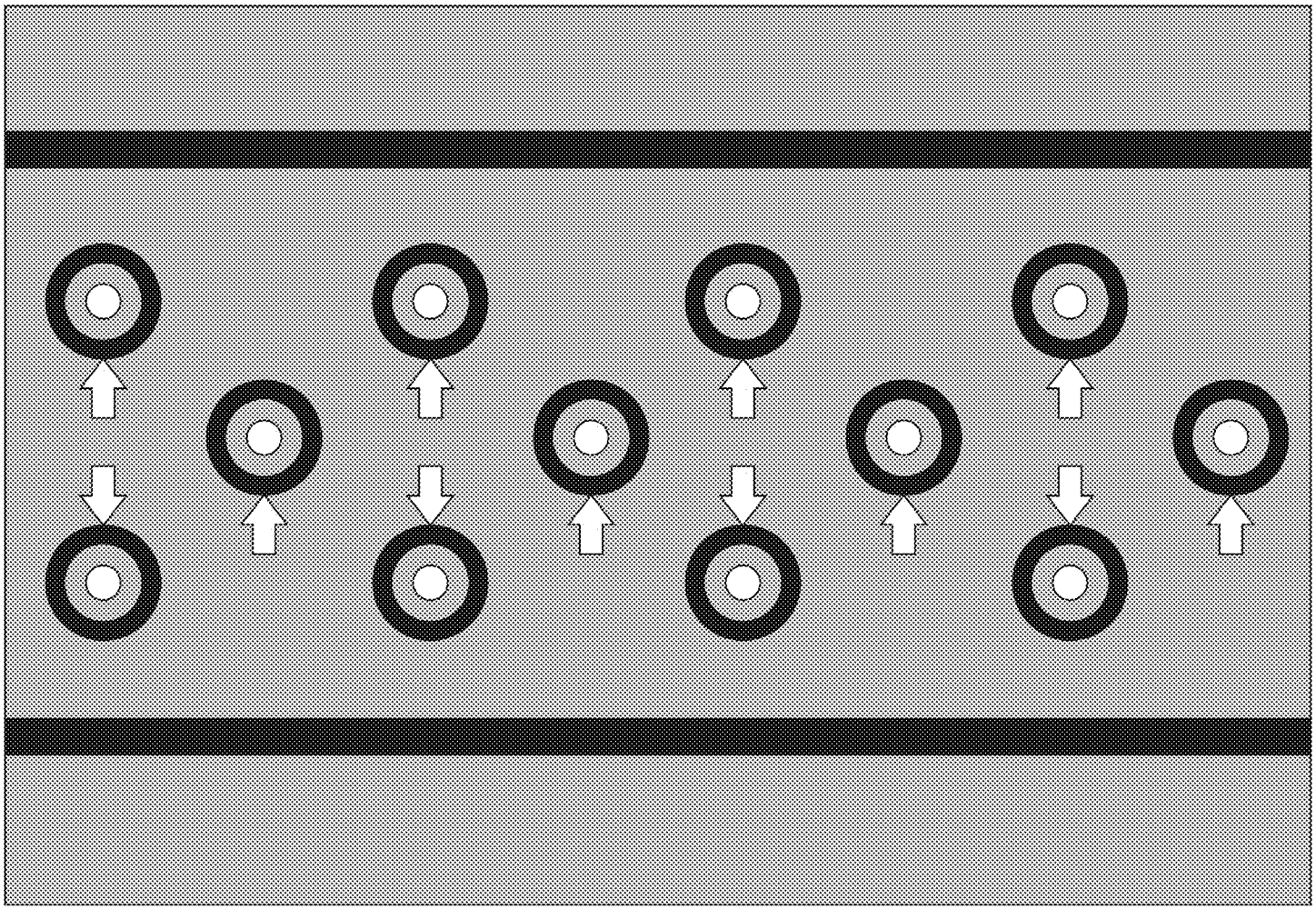
FIG. 6 (Prior Art)
FIG. 6 illustrates an artifact produced by drying an aqueous ink image on a substrate supported by a transport belt that is narrower than the substrate and having large diameter holes that slides over a vacuum plenum platen.

A process for operating the dryers of FIG. 2 and FIG. 4 is shown in FIG. 5. The process begins with the retraction of the cooler components from the belt (block 504). The type of media for the print job is identified by, for example, receiving it as a print job parameter from the user interface, and the controller determines whether belt cooling is required for the print job (block 508). If the cooler is not needed, it remains retracted (block 512). If belt cooling is required for the type of media to be printed, then the weight of the media is identified and compared to a predetermined threshold (block 516). In one embodiment, the weight of the different types of media that can be printed by the printer are stored in a memory and the predetermined threshold is 150 grams per square meter. If the weight of the media exceeds the predetermined threshold, the cooler remains retracted (block 520). If the weight of the media is less than or equals the predetermined threshold, then the fan is activated and either fluid is applied to the belt or the heat sink is moved into engagement with the belt (block 524). As long as the belt temperature remains below a predetermined threshold, which in one embodiment is 50 degrees C. (block 528), the cooler remains engaged with the belt (block 532). When the temperature of the belt equals or exceeds the predetermined threshold, then the fan speed and either the amount of fluid applied or the area of the heat sink engaging the belt is compared to the maximum set point for these parameters (block 536). If these set points are not at their maximum, then the fan speed and either the amount of fluid applied or the area of the heat sink set points are increased and the operation of the cooler is adjusted accordingly (block 540). This loop of checking the belt temperature and the operational set points for the cooler (blocks 528, 536, and 540) continues until the maximum set points are reached and the cooler is operating at those set points. If the maximum set points are reached without the belt temperature staying below the predetermined threshold, then a signal is sent to the user interface to alert the user to an occurrence of a possible image defect (block 544). At the end of the print job, the belt cooler is retracted (block 548) and the fan continues to direct air onto the heat sink in the heat sink embodiment until the heat sink temperature falls below a predetermined threshold (block 552), which in one embodiment is 30 degrees C.

As noted previously, thin polyimide media transport belts with low thermal mass gain and loose heat energy at significantly higher rates than thicker silicone belts. Thin belts heat and cool rapidly resulting in higher temperature differentials between areas of the belt in the inter-document gap that absorb more heat energy than belt areas covered by the substrates. This effect produces multiple cross-process direction bands of temperature differentials around the circumference of the belt. The belt cooling embodiments mentioned above are effective at minimizing the temperature differentials between the areas exposed to the heater 192 and those areas covered by the media.

Combining these aspects into the dryer 160 shown in FIG. 1 results in the belt 164 being a relatively thin, heat reflective or transparent belt that covers the vacuum plenum completely in the cross-process direction and has holes with a diameter of less than 300 μm that are arranged in a two-dimensional array having a hole to hole pitch that ranges from about 2 mm to about 5 mm so the substrates are held to the belt by the vacuum applied to the holes. The vacuum plenum 184 has no platen covering it but narrow support members 264 with continuous surfaces contacting the belt can be positioned in the cross-process direction or at an angle to the cross-process direction to provide support for the belt 164, if necessary, without introducing temperature differentials that occur at the holes in the belts and platens of previously known vacuum plenums. The open plenum also enables uniform vacuum air flow at every hole in the belt passing over the plenum.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

at least one printhead configured to eject drops of an ink onto substrates moving past the at least one printhead to form ink images on the substrates;

a dryer having a heater, a media transport belt cooler, and a media transport belt, the media transport belt being configured to move the substrates past the heater after the ink images have been formed on the substrates and the media transport belt cooler being positioned to remove heat energy from the media transport belt after the media transport belt has passed the heater and the substrates have separated from the media transport belt; and the media transport belt cooler further comprising: a fluid applicator, the fluid applicator being configured to apply fluid from a fluid source to the media transport belt after the media transport belt has passed the heater and the substrates have separated from the media transport belt.

2. The inkjet printer of claim 1 wherein the media transport belt is comprised of a material that is reflective or transparent of heat energy generated by the heater.

3. The inkjet printer of claim 2 wherein the media transport belt is comprised of one of a polyimide, a polyethylene, and a polypropylene.

4. The inkjet printer of claim 3 wherein the media transport belt has holes, each hole in the media transport belt has a diameter that is less than 300 μm.

5. The inkjet printer of claim 4 wherein the media transport belt has a thickness less than 200 μm so the thermal mass of the media transport belt is less than a silicone belt of a same length and a same width as the media transport belt.

6. The inkjet printer of claim 5 further comprising:

a plenum having sides and a bottom that form a structure having a U-shaped cross-section that encloses a volume of air that is adjacent the media transport belt without intervening structure; and a vacuum source that is operatively coupled to the volume of air in the plenum to pull a vacuum through the holes in the media transport belt.

7. The inkjet printer of claim 6 wherein a width of the media transport belt is at least a distance between the sides of the plenum in a cross-process direction.

8. The inkjet printer of claim 7, the plenum further comprising:

at least one support member extending between the sides of the plenum in the cross-process direction, the at least one support member having a length in the cross-process direction that is greater than a width of the support member in the process direction and the at least one support member having a continuous surface that contacts the media transport belt.

9. The inkjet printer of claim 8 wherein the holes in the media transport belt are arranged in a two-dimensional array having a hole to hole pitch that ranges from 2 mm to 5 mm.

10. A dryer for an inkjet printer comprising:

a heater;

a media transport belt cooler;

a media transport belt, the media transport belt being configured to move substrates past the heater after ink images have been formed on the substrates and the media transport belt cooler being positioned to remove heat energy from the media transport belt after the media transport belt has passed the heater and the substrates have separated from the media transport belt; and the media transport belt cooler further comprising: a fluid applicator, the fluid applicator being configured to apply fluid from a fluid source to the media transport belt after the media transport belt has passed the heater and the substrates have separated from the media transport belt.

11. The dryer of claim 10 wherein the media transport belt is comprised of a material that is reflective or transparent of heat energy generated by the heater.

12. The dryer of claim 11 wherein the media transport belt is comprised of one of a polyimide, a polyethylene, and a polypropylene.

13. The dryer of claim 12 wherein the media transport belt has holes, each hole in the media transport belt has a diameter that is less than 300 μm.

14. The dryer of claim 13 wherein the media transport belt has a thickness less than 200 μm so the thermal mass of the media transport belt is less than a silicone belt of a same length and a same width as the media transport belt.

15. The dryer of claim 14 further comprising:

a plenum having sides and a bottom that form a structure having a U-shaped cross-section that encloses a volume of air that is adjacent the media transport belt without intervening structure; and a vacuum source that is operatively coupled to the volume of air in the plenum to pull a vacuum through the holes in the media transport belt.

16. The dryer of claim 15 wherein a width of the media transport belt is at least a distance between the sides of the plenum in the cross-process direction.

17. The dryer of claim 16, the plenum further comprising:

at least one support member extending between the sides of the plenum in the cross-process direction, the at least one support member having a length in the cross-process direction that is greater than a width of the support member in the process direction and the at least one support member having a continuous surface that contacts the media transport belt.

18. The inkjet printer of claim 17 wherein the holes in the media transport belt are arranged in a two-dimensional array having a hole to hole pitch that ranges from 2 mm to 5 mm.

* * * * *